US007657204B2

(12) United States Patent
Yang

(10) Patent No.: US 7,657,204 B2
(45) Date of Patent: Feb. 2, 2010

(54) LOCKING APPARATUS AND IMAGE FORMING APPARATUS HAVING THE SAME

(75) Inventor: Myung-woo Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 140 days.

(21) Appl. No.: 11/869,867

(22) Filed: Oct. 10, 2007

(65) Prior Publication Data

US 2008/0181681 A1 Jul. 31, 2008

(30) Foreign Application Priority Data

Jan. 26, 2007 (KR) ..... 10-2007-0008305

(51) Int. Cl.
*G03G 15/01* (2006.01)

(52) U.S. Cl. ..... 399/107; 399/121; 399/125; 399/302; 399/308

(58) Field of Classification Search ..... 399/121, 399/107, 125, 302, 308
See application file for complete search history.

(56) References Cited

U.S. PATENT DOCUMENTS

2002/0098009 A1 7/2002 Nakamura et al.
2006/0072929 A1* 4/2006 Takahashi ..... 399/13

FOREIGN PATENT DOCUMENTS

| | | |
|---|---|---|
| EP | 1 008 917 | 6/2000 |
| EP | 1 331 525 | 7/2003 |
| EP | 1 569 050 | 8/2005 |
| EP | 1 637 937 | 3/2006 |
| JP | 2002-139976 | 5/2002 |
| JP | 2003107847 A * | 4/2003 |

OTHER PUBLICATIONS

European Search Report dated Apr. 22, 2008 issued in EP 07121038.9.

* cited by examiner

*Primary Examiner*—David M Gray
*Assistant Examiner*—G.M. Hyder
(74) *Attorney, Agent, or Firm*—Stanzione & Kim LLP

(57) ABSTRACT

A locking apparatus includes a lever unit disposed at an intermediate transfer belt frame to cause an intermediate transfer belt to contact a photosensitive medium; a locking unit disposed at a supporting cover to cause the supporting cover to be fixed to and separated from an engine frame; and a coupling unit to cause the lever unit to operate in association with the locking unit.

19 Claims, 6 Drawing Sheets

LOCKING APPARATUS AND IMAGE FORMING APPARATUS HAVING THE SAME

CROSS-REFERENCE TO RELATED APPLICATIONS

This application claims the benefit under 35 U.S.C. § 119 (a) from Korean Patent Application No. 2007-8305 filed Jan. 26, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to an image forming apparatus to use an intermediate transfer belt.

2. Description of the Related Art

Generally, an image forming apparatus to use an intermediate transfer belt has four image forming units so that it overlappingly transfers images formed on each of the four image forming units onto the intermediate transfer belt to form full color images.

FIGS. 1 and 2 are a partial perspective view illustrating a conventional image forming apparatus.

Referring to FIGS. 1 and 2, a conventional image forming apparatus 1 includes an engine frame 10, four toner cartridges 13, four image forming units 14, an intermediate transfer belt unit 20, and a supporting cover 30.

The engine frame 10 supports the four toner cartridges 13, the four image forming units 14, the intermediate transfer belt unit 20, and the supporting cover 30. Around the engine frame 10 are disposed a printing medium feeding unit (not illustrated) that holds and feeds printing media, a printing medium moving unit (not illustrated) to move a printing medium, a transferring unit (not illustrated) to transfer color images formed on the intermediate transfer belt onto the printing medium, a fusing unit (not illustrated) to fuse the transferred images onto the printing medium, and a discharging unit (not illustrated) to discharge the fused printing medium outside.

Each of the four toner cartridges 13 holds a different color toner to develop electrostatic latent images formed on each of the image forming units 14. In general, the four toner cartridges 13 hold black, yellow, magenta, and cyan toners, respectively.

Each of the four image forming units 14 forms predetermined images corresponding to printing data and includes a photosensitive medium (not illustrated), a charging unit (not illustrated) to charge a surface of the photosensitive medium with a predetermined voltage, an exposure unit (not illustrated) to form electrostatic latent images on the surface of the photosensitive medium, and a developing unit (not illustrated) to develop the electrostatic latent images formed on the photosensitive medium with toner supplied from the toner cartridge 13.

The intermediate transfer belt unit 20 supports an intermediate transfer belt 21 to move endlessly in a closed loop, and includes the intermediate transfer belt 21 and an intermediate transfer belt frame 23. Four transfer backup rollers (not illustrated) are disposed in positions corresponding to the photosensitive media of the four image forming units 14 inside the intermediate transfer belt 21.

A fixing lever 40 is disposed at the engine frame 10 at a side of the transfer backup roller to transfer black toner images from the photosensitive medium to the intermediate transfer belt 21. When turning the fixing lever 40 in a first direction, the fixing lever 40 presses the transfer backup roller to cause the intermediate transfer belt 21 to come in contact with the photosensitive medium of the image forming unit 14*a*, to form the black toner images. Then, the images on the photosensitive medium are transferred to the intermediate transfer belt 21. However, in this state, when separating the image forming unit 14*a*, the photosensitive medium thereof rubs against the intermediate transfer belt 21 so that damages such as scratches may occur at the surfaces of the photosensitive medium and the intermediate transfer belt 21.

When turning the fixing lever 40 in a second direction, the transfer backup roller is released from the fixing lever 40 so that the intermediate transfer belt 21 comes apart from the photosensitive medium. In this state, when separating the image forming unit 14*a*, the photosensitive medium thereof does not rub against the intermediate transfer belt 21 so that no damages occur at the surfaces of the photosensitive medium and the intermediate transfer belt 21.

The supporting cover 30 rotatably supports a shaft 15 of each of the four photosensitive media so that the four photosensitive media of the image forming units 14 can maintain predetermined intervals therebetween and rotate. Two locking levers 32 are disposed at an outer surface of the supporting cover 30. Two locking brackets 12 are disposed at positions of the engine frame 10 corresponding to the two locking levers 32. Therefore, the supporting cover 30 is pushed against the side of the engine frame 10, and then, the two locking levers 32 are turned to hook the locking brackets 12 so that the supporting cover 30 is fixed to the engine frame 10. Also, the locking levers 32 are turned in a reverse direction to escape from the locking brackets 12 so that the supporting cover 30 can be separated from the engine frame 10.

However, the conventional image forming apparatus 1 is configured so that the locking levers 32 to fix the supporting cover 30 to the engine frame 10 and the fixing levers 40 to cause the intermediate transfer belt 21 to contact the photosensitive medium operate separately.

As a result, in order to separate the image forming unit 14 from the engine frame 10, the locking levers 32 and the fixing levers 40 are required to be operated separately. In other words, the two locking levers 32 are turned, and then, the supporting cover 30 is separated from the engine frame 10 so that the fixing levers 40 are exposed as illustrated in FIG. 2. After that, when turning the fixing levers 40, the intermediate transfer belt 21 comes apart from the photosensitive medium. In this state, when the image forming unit 14*a* is separated, the photosensitive medium thereof does not rub against the intermediate transfer belt 21 so that no damage occurs.

After mounting the image forming unit 14*a*, the supporting cover 30 is mounted in the opposite of the above described procedure. In other words, after the image forming unit 14*a* is mounted, the fixing levers 40 are turned to cause the intermediate transfer belt 21 to come in contact with the photosensitive medium. After that, the supporting cover 30 is pushed against the engine frame 10, and then, the locking levers 32 are turned so that the supporting cover 30 is fixed to the engine frame 10.

In the conventional image forming apparatus 1, when replacing or maintaining the image forming unit 14*a*, it is required to turn the locking levers 32 and the fixing lever 40 in order. Therefore, users experience inconvenience when replacing or maintaining the image forming unit 14*a*.

SUMMARY OF THE INVENTION

The present general inventive concept provides a locking apparatus and an image forming apparatus having the same, which is capable of fixing a plurality of parts by one action.

Additional aspects and utilities of the present general inventive concept will be set forth in part in the description which follows and, in part, will be obvious from the description, or may be learned by practice of the general inventive concept.

The foregoing and/or other aspects and utilities can be achieved by providing a locking apparatus of an image forming apparatus, which includes a lever unit disposed at an intermediate transfer belt frame to cause an intermediate transfer belt to contact a photosensitive medium, a locking unit disposed at a supporting cover to cause the supporting cover to be fixed to and separated from an engine frame, and a coupling unit to cause the lever unit to operate in association with the locking unit.

The lever unit includes a lever shaft rotatably supported by the intermediate transfer belt frame, and at least one press lever disposed at the lever shaft so as to be substantially vertical to the lever shaft.

The lever unit may further include a fixing lever disposed at an end of the lever shaft to fix the intermediate transfer belt frame not to be separated from the engine frame in an axial direction of the lever shaft.

The locking unit includes a locking handle rotatably disposed at the supporting cover, a cam gear coaxially disposed with the locking handle to rotate integrally with the locking handle, and a cover fixing member disposed at a side of the cam gear to project from a side surface of the supporting cover or to move inside the supporting cover according to an operation of the locking handle.

Also, the locking unit may further include an elastic member to support the cover fixing member to move inside the supporting cover.

The cam gear includes a gear part to cause the coupling unit to rotate, and a cam part to cause the cover fixing member to move.

The coupling unit includes a first coupling disposed at the lever unit, a second coupling detachably coupled with the first coupling, and a coupling gear coaxially connected with the second coupling and rotatably disposed at the supporting cover.

The second coupling can be provide with a plurality of jaws, and the first coupling can be provided with a plurality of holes into which the plurality of jaws is inserted.

Also, the second coupling can be disposed at a shaft of the coupling gear so that it can move in an axial direction of the shaft of the coupling gear, and wherein the coupling unit further comprises a press member disposed between the second coupling and the coupling gear.

The foregoing and/or other aspects and utilities of the present general inventive concept may also be achieved by providing an image forming apparatus that includes an engine frame disposed inside the image forming apparatus, an intermediate transfer belt unit disposed inside the engine frame to support an intermediate transfer belt to move endlessly in a closed loop, at least one image forming unit disposed below the intermediate transfer belt unit to comprise a photosensitive medium, a lever unit disposed at an intermediate transfer belt frame of the intermediate transfer belt unit to cause the intermediate transfer belt to contact the photosensitive medium, a locking unit disposed at a supporting cover to cause the supporting cover to be fixed to and separated from the engine frame, and a coupling unit to cause the lever unit to operate in association with the locking unit.

The supporting cover can include at least one shaft hole formed at an inner surface thereof to support a shaft of the photosensitive medium of the at least one image forming unit.

The image forming apparatus may further include at least one reference bushing disposed at the supporting cover, and at least one reference pin disposed at the engine frame corresponding to the at least one reference bushing, wherein when the supporting cover is mounted to the engine frame, the reference pin is inserted into the reference bushing.

The foregoing and/or other aspects and utilities of the present general inventive concept may also be achieved by providing a locking apparatus of an image forming apparatus including a first member to extend and cause an intermediate transfer belt to contact a photosensitive medium, a second member to extend to and retract from a supporting cover to cause the supporting cover to be fixed to and separated from an engine frame, and a coupling unit to cause the first member to operate in association with the second member.

The coupling unit can include a first coupling disposed at the first member, a second coupling detachably coupled with the first coupling, and a coupling gear coaxially connected with the second coupling and rotatably disposed at the supporting cover.

The coupling unit may further include a cam gear to simultaneously rotate the coupling gear and to extend retract the second member.

BRIEF DESCRIPTION OF THE DRAWINGS

These and/or other aspects and utilities of the general inventive concept will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE PREFERRED EMBODIMENTS

Figure 1:
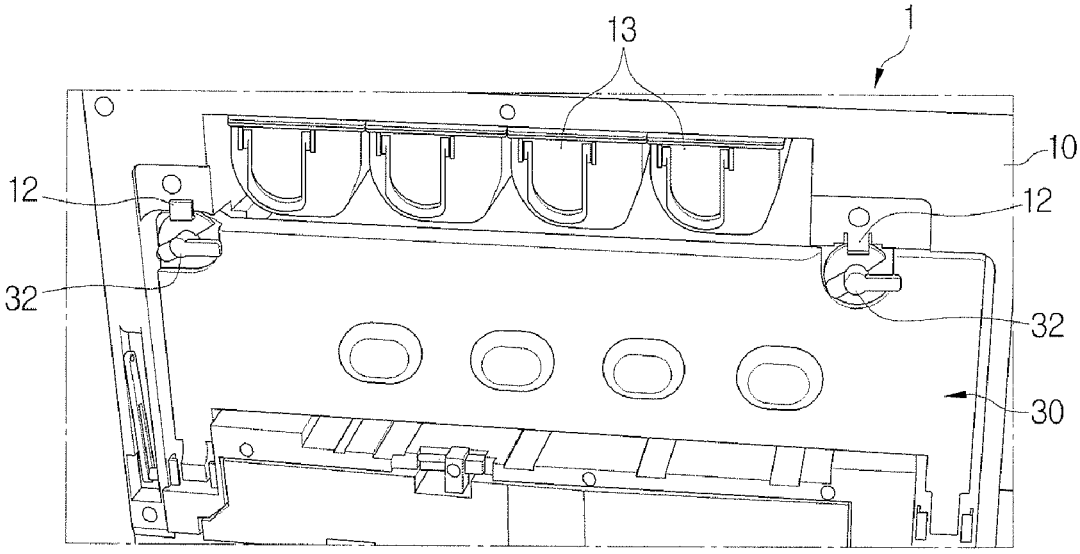
FIG. 1 (PRIOR ART)
FIG. 1 is a partial perspective view illustrating a conventional image forming apparatus with a supporting cover.
Figure 2:
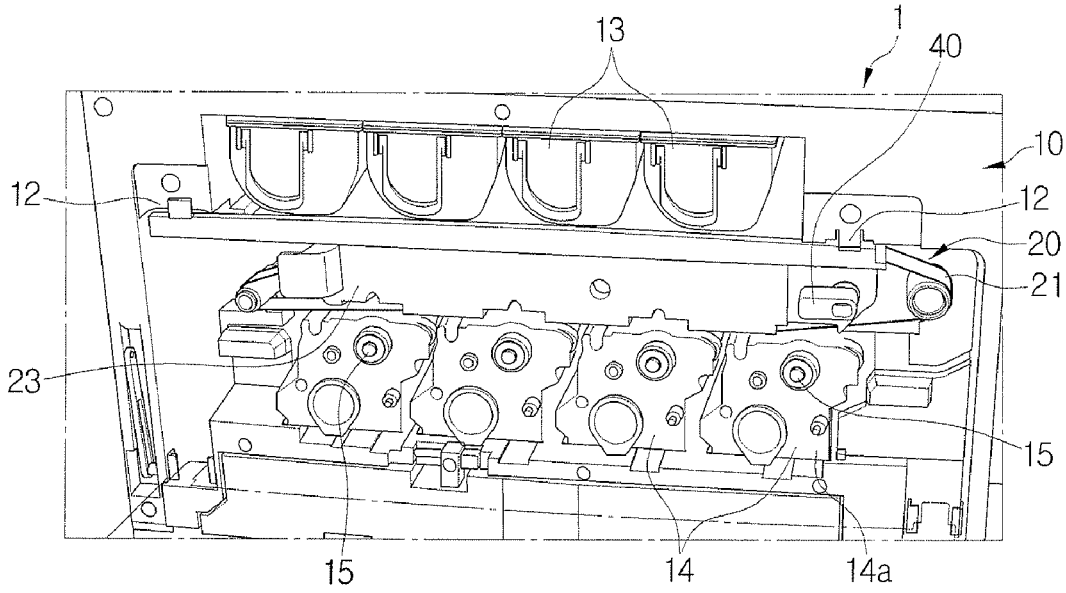
FIG. 2 (PRIOR ART)
FIG. 2 is a partial perspective view illustrating the conventional image forming apparatus of FIG. 1 without the supporting cover.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description, such as a detailed construction and elements thereof, are provided to assist in a comprehensive understanding of the general inventive concept. Thus, it is apparent that the present general inventive concept may be carried out without those defined matters. Also, well-known functions or constructions are omitted to provide a clear and concise description of exemplary embodiments.

Figure 3:
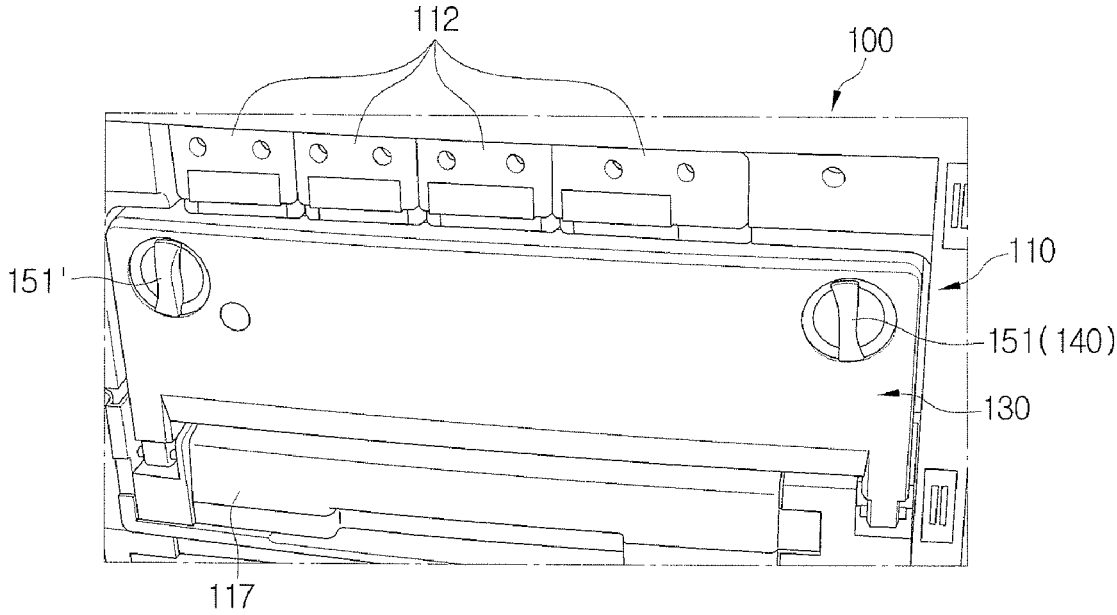
FIG. 3 is a partial perspective view illustrating an image forming apparatus with a locking apparatus according to an embodiment of the present general inventive concept.
Figure 4:
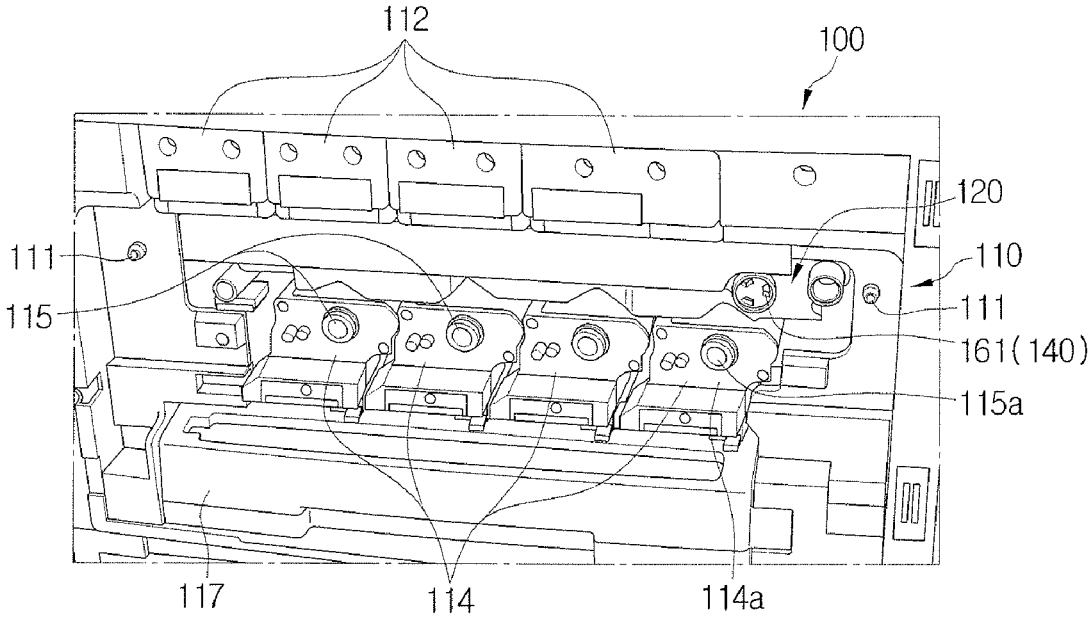
FIG. 4 is a partial perspective view illustrating the image forming apparatus of FIG. 3 without a supporting cover.

FIGS. 3 and 4 are a partial perspective view illustrating an image forming apparatus according to an embodiment. FIG. 3 illustrates the image forming apparatus with a supporting cover, and FIG. 4 illustrates the image forming apparatus without the supporting cover.

Referring to FIGS. 3 and 4, an image forming apparatus 100 according to an embodiment includes an engine frame 110, a plurality of toner cartridges 112, a plurality of image forming units 114, an intermediate transfer belt unit 120, a supporting cover 130, a used toner receptacle 117, and a locking unit 140.

The engine frame 110 supports the plurality of toner cartridges 112, the plurality of image forming units 114, the intermediate transfer belt unit 120, and the supporting cover 130. Around the engine frame 110 are disposed a printing medium feeding unit (not illustrated) that holds and feeds printing media, a printing medium moving unit (not illustrated) to move a printing medium, a transferring unit (not illustrated) to transfer color images formed on the intermediate transfer belt onto the printing medium, a fusing unit (not illustrated) to fuse the transferred images onto the printing medium, and a discharging unit (not illustrated) to discharge the fused printing medium outside. Since the printing medium feeding unit, the printing medium moving unit, the transferring unit, and the discharging unit are substantially the same as those of a conventional image forming apparatus, detailed descriptions and drawings thereof will not be presented.

Each of the plurality of toner cartridges 112 is disposed at an upper part of the engine frame 110 and holds a different color toner to develop electrostatic latent images formed on the photosensitive medium 116 (see FIG. 9A) of the image forming unit 114. The image forming apparatus 100 according to an embodiment has four toner cartridges 112, and the toner cartridges 112 can hold black, yellow, magenta, and cyan toners, respectively. However other toners can be contained in the toner cartridges 112.

The plurality of image forming units 114 form predetermined images corresponding to printing data and are disposed below the intermediate transfer belt unit 120. Each of the image forming units 114 includes a photosensitive medium 116, a charging unit (not illustrated) to charge a surface of the photosensitive medium 116 with a predetermined voltage, an exposure unit (not illustrated) to form electrostatic latent images on the surface of the photosensitive medium 116, and a developing unit (not illustrated) to develop the electrostatic latent images formed on the photosensitive medium 116 with toner supplied from the toner cartridge 112. The image forming apparatus 100 according to this embodiment uses four image forming units 114 corresponding to the four toner cartridges 112. Therefore, the four image forming units 114 form black, yellow, magenta, and cyan toner images, respectively, on the photosensitive medium 116 thereof.

The intermediate transfer belt unit 120 is disposed at the engine frame 110 below the plurality of toner cartridges 112 and includes an intermediate transfer belt 121 (see FIGS. 9A and 9B), an intermediate transfer belt frame 123 (see FIG. 6), a drive roller (not illustrated), and a driven roller (not illustrated). The intermediate transfer belt 121 is disposed at the intermediate transfer belt frame 123 and moves endlessly in a closed loop by the drive and driven rollers. When the intermediate transfer belt 121 moves endlessly in a closed loop, images formed on the photosensitive medium 116 of each of the plurality of image forming units 114 are overlappingly transferred onto the intermediate transfer belt 121. A transfer backup roller 181 (see FIG. 9A) is disposed in each position corresponding to a respective one of the photosensitive media 116 of the plurality of image forming units 114 inside the intermediate transfer belt 121. The image forming apparatus 100 according to an embodiment is provided with four transfer backup rollers 181 corresponding to the four image forming units 114. The four transfer backup rollers 181 support the intermediate transfer belt 121 to contact the photosensitive media 116 of the image forming units 114 so that images formed on the photosensitive media 116 are transferred onto the intermediate transfer belt 121.

Figure 5:
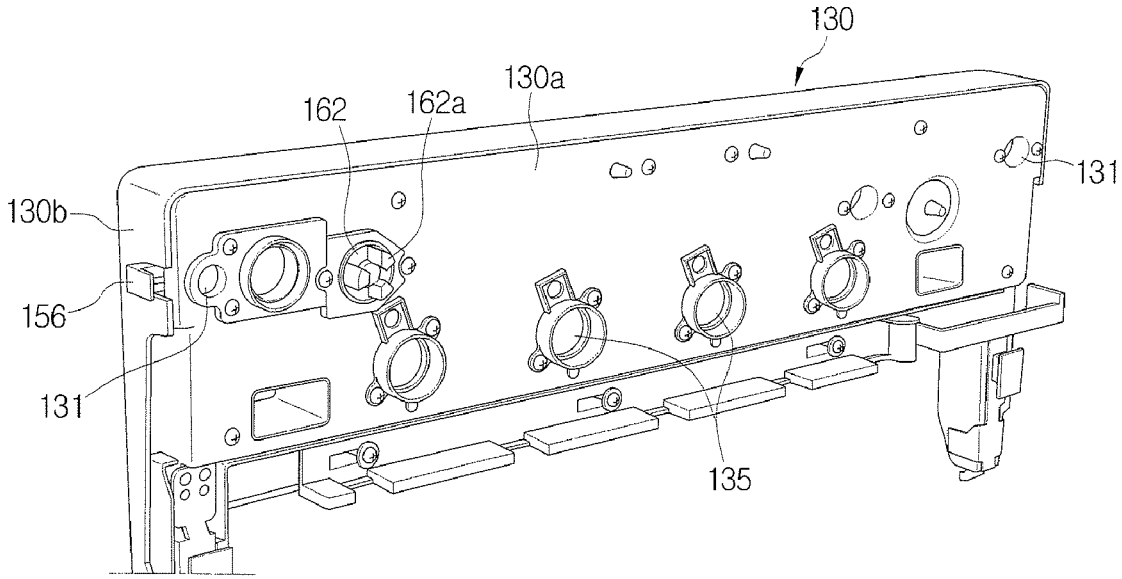
FIG. 5 is a rear perspective view illustrating a supporting cover of the image forming apparatus of FIG. 3.

The supporting cover 130 is detachably disposed at a side of the engine frame 110, and rotatably supports a shaft 115 of each of the plurality of photosensitive media 116 so that the photosensitive media 116 of the plurality of image forming units 114 can maintain intervals therebetween and rotate. Therefore, at an inner surface 130*a* of the supporting cover 130, as illustrated in FIG. 5, is formed a plurality of shaft holes 135 to rotatably support the shafts 115 of the plurality of photosensitive media 116. The image forming apparatus 100 according this embodiment is provided with four shaft holes 135 formed at the inner surface 130*a* of the supporting cover 130 so as to support shafts 115 of the four photosensitive media 116.

Also, at least one reference bushing 131 is disposed at the inner surface 130*a* of the supporting cover 130 so that when the supporting cover 130 is fixed to the engine frame 110, it guides the supporting cover 130 to be fixed to a correct position. At the engine frame 110 is disposed at least one reference pin 111 (see FIG. 6) that is inserted into the at least one reference bushing 131 for the supporting cover 130 to be fixed to the correct position. A pair of reference bushings 131 and reference pins 111 may be disposed at the supporting cover 130 and the engine frame 110 at predetermined intervals.

The used toner receptacle 117 is disposed below the engine frame 110, and collects used toner discharged from the plurality of image forming units 114 and the intermediate transfer belt 121.

The locking apparatus 140 causes the supporting cover 130 to be detachably fixed to the engine frame 110, the intermediate transfer belt 121 to come in contact with the photosensitive medium 116 of the image forming unit 114*a* to form black toner images, and the intermediate transfer belt unit 120 to be fixed to the engine frame 110. The locking apparatus 140, referring to FIGS. 6 and 7, includes a lever unit 170, a locking unit 150, and a coupling unit 160.

The lever unit 170 is disposed at the intermediate transfer belt frame 123, and causes the intermediate transfer belt 121 to be in contact with the photosensitive medium 116. The lever unit 170 is provided with a lever shaft 171 to be rotatably supported by the intermediate transfer belt frame 123, and at least one press lever 173 that is disposed at the lever shaft 171 and substantially vertical to the lever shaft 171. In the image forming apparatus 100 according to this embodiment, the lever unit 170 may have two press levers 173.

Figure 9A:
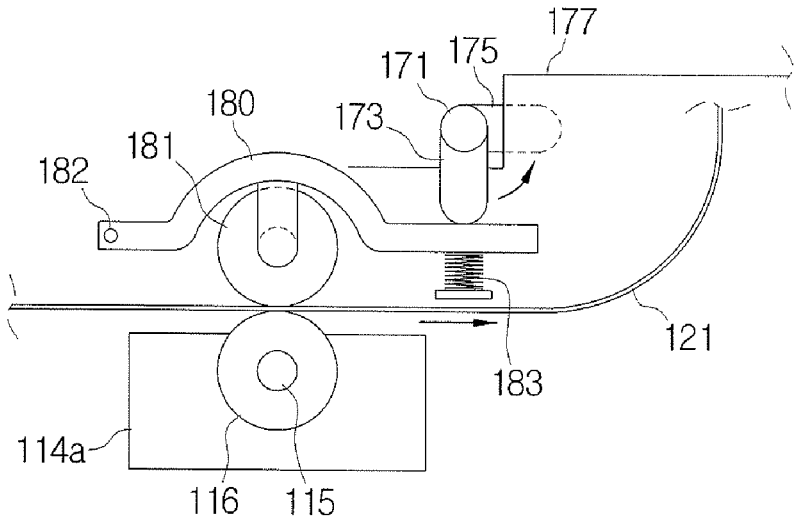
FIGS. 9A and 9B are a schematic view illustrating operation of a lever unit of a locking apparatus according to an embodiment of the present general inventive concept.

The press lever 173 is formed so that when it moves to a press position as illustrated in FIG. 9A, a front end of the press lever 173 can press a first end of a press plate 180. A second end of the press plate 180 is disposed by hinge 182 inside the intermediate transfer belt frame 123. As a result, when the press lever 173 presses the first end of the press plate 180, the transfer backup roller 181, which is rotatably disposed at the press plate 180, moves downwardly. Then, the transfer backup roller 181 presses the intermediate transfer belt 121 to come in contact with the photosensitive medium 116 of the image forming unit 114*a*.

Figure 9B:
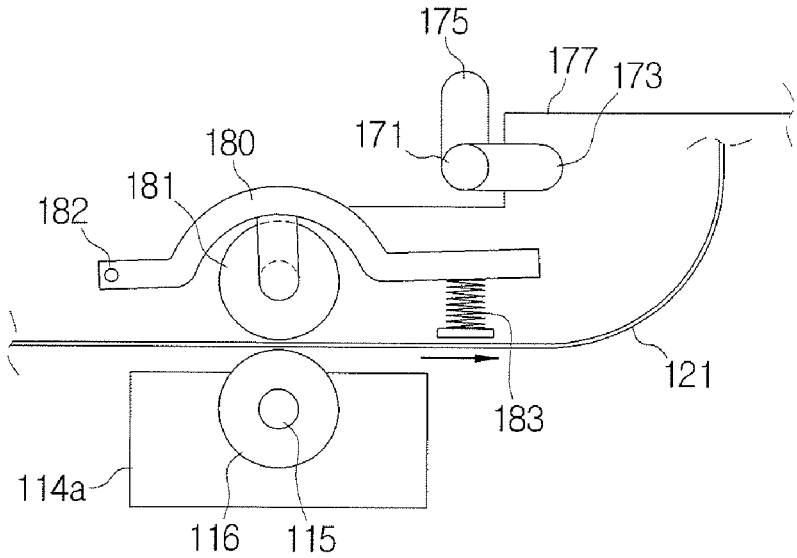

As illustrated in FIG. 9B, when the lever shaft 171 rotates in a reverse direction to cause the press lever 173 to leave the press position, the first end of the press plate 180 moves upwardly due to a return member 183. Then, the intermediate transfer belt 121 is separated from the photosensitive medium 116.

The lever unit 170 may further include a fixing lever 175. The fixing lever 175 is disposed at a side of the lever shaft 171 and causes the intermediate transfer belt unit 120 to be fixed to a predetermined position of the engine frame 110. In other words, the fixing lever 175 fixes the intermediate transfer belt frame 123 to the engine frame 110 so that the intermediate transfer belt frame 123 does not become separated from the engine frame 110 in an axial direction of the lever shaft 171. When the press lever 173 moves to at the press position of pressing the press plate 180, the fixing lever 175 inserts into a fixing recess 177 formed at the engine frame 110. Therefore, when the press lever 173 moves away from the press position, the fixing lever 175 also moves away from the fixing recess 177.

The locking unit 150 is disposed at the supporting cover 130 to cover a side surface of the intermediate transfer belt unit 120, and formed to cause the supporting cover 130 to be fixed to or separated from the engine frame 110. The locking unit 150 includes a locking handle 151 to be rotatably disposed at an outer surface of the supporting cover 130, a cam gear 153 coaxially coupled with the locking handle 151 to rotate integrally with the locking handle 151, and a cover fixing member 156 disposed at a side of the cam gear 153. The cover fixing member 156 projects from a side surface 130*b* of the supporting cover 130 or moves inside the supporting cover 130 according to an operation of the locking handle 151. In other words, the locking handle 151 can control the position of the cover fixing member 156. Also, inside the supporting cover 130 is disposed an elastic member 157 to press the cover fixing member 156 to move inside the supporting cover 130.

Figure 8A:
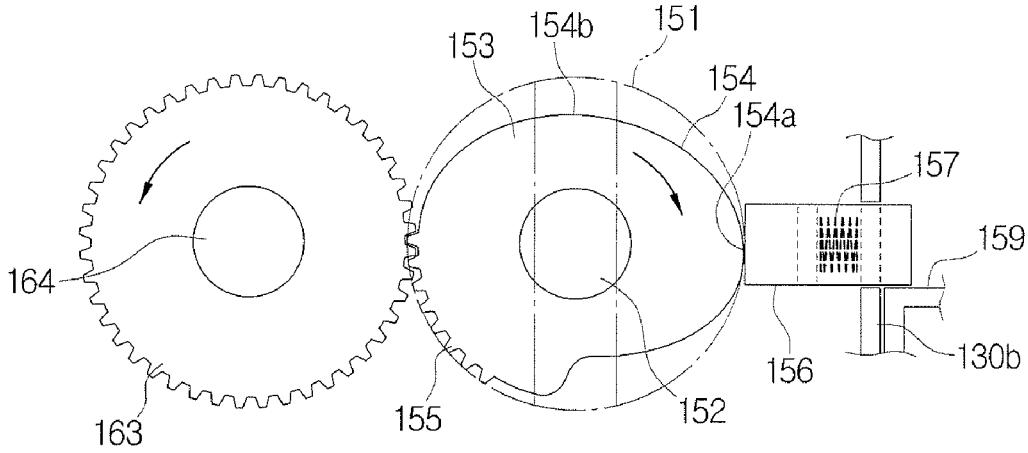
FIGS. 8A and 8B are a schematic view illustrating operation of a locking unit of a locking apparatus according to an embodiment of the present general inventive concept.

The cam gear 153 is disposed to rotate integrally with the locking handle 151 via a cam gear shaft 152, and is provided with a gear part 155 and a cam part 154 as illustrated in FIG. 8A. The gear part 155 of the cam gear 153 is formed to engage with a coupling gear 163 of the coupling unit 160 within a rotation range of the locking handle 151. Therefore, a rotation of the locking handle 151 causes the coupling gear 163 to rotate. The cam part 154 of the cam gear 153 is formed to cause the cover fixing member 156 to project from the side surface 130*b* of the supporting cover 130 or move inside the supporting cover 130 according to rotation of the locking handle 151.

A cam profile of the cam part 154 of the cam gear 153 is formed to have a high point 154*a* at which the cam part 154 pushes the cover fixing member 156 to cause a front end of the cover fixing member 156 to project from the side surface 130*b* of the supporting cover 130, and a low point 154*b* at which the cam part 154 causes the front end of the cover fixing member 156 to move inside the supporting cover 130. Therefore, when the locking handle 151 rotates the cam gear 153 so that the cam part 154 of the cam gear 153, which is in contact with a back end of the cover fixing member 156, rotates from the low point 154*b* to the high point 154*a*, the front end of the cover fixing member 156 projects from the side surface 130*b* of the supporting cover 130. Also, when the locking handle 151 rotates the cam gear 153 in a reverse direction so that the cam part 154 of the cam gear 153, which is in contact with the back end of the cover fixing member 156, rotates from the high point 154*a* to the low point 154*b*, the cover fixing member 156 moves back inside the supporting cover 130 due to a force of the elastic member 157. At this position, the front end of the cover fixing member 156 does not project from the side surface 130*b* of the supporting cover 130.

Figure 6:
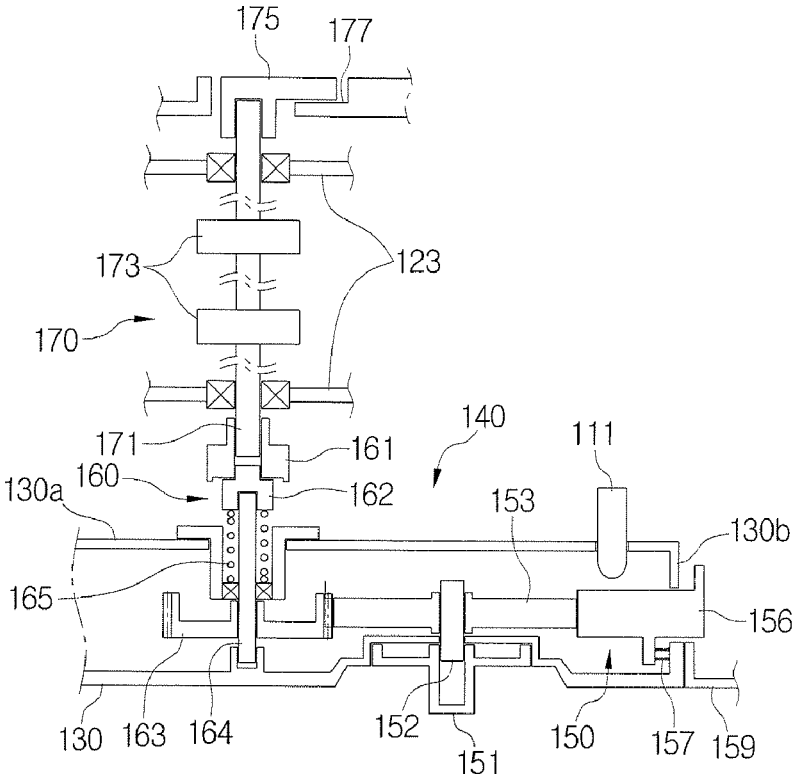
FIG. 6 is a sectional view schematically illustrating a locking apparatus according to an embodiment of the present general inventive concept.

When the locking handle 151 rotates in a first direction, the cam part 154 of the cam gear 153 causes the cover fixing member 156 to project from the side surface 130*b* of the supporting cover 130, and the gear part 155 of the cam gear 153 causes the lever shaft 171 to rotate so that the press lever 173 presses the press plate 180 (FIGS. 9A and 9B) and the fixing lever 175 moves into the fixing recess 177 (FIG. 6). When the locking handle 151 rotates in a second direction, the cover fixing member 156 is returned inside the supporting cover 130 by the cam part 154 of the cam gear 153 and the elastic member 157, and the press lever 173 and fixing lever 175 are respectively moved away from the press plate 180 and the fixing recess 177 by the gear part 155 of the cam gear 153.

The coupling unit 160 allows the lever unit 170 to operate in association with the locking unit 150, and the supporting cover 130 to be separated from the engine frame 110. In other words, when the supporting cover 130 is separated from the engine frame 110, the coupling unit 160 allows the locking unit 150 of the locking apparatus 140 to be separated from the lever unit 170 thereof. When the supporting cover 130 is fixed to the engine frame 110, the coupling unit 160 allows the locking unit 150 of the locking apparatus 140 to be connected with the lever unit 170 thereof so that operation of the locking handle 151 is transmitted to the lever unit 170 via the coupling unit 160.

Figure 7:
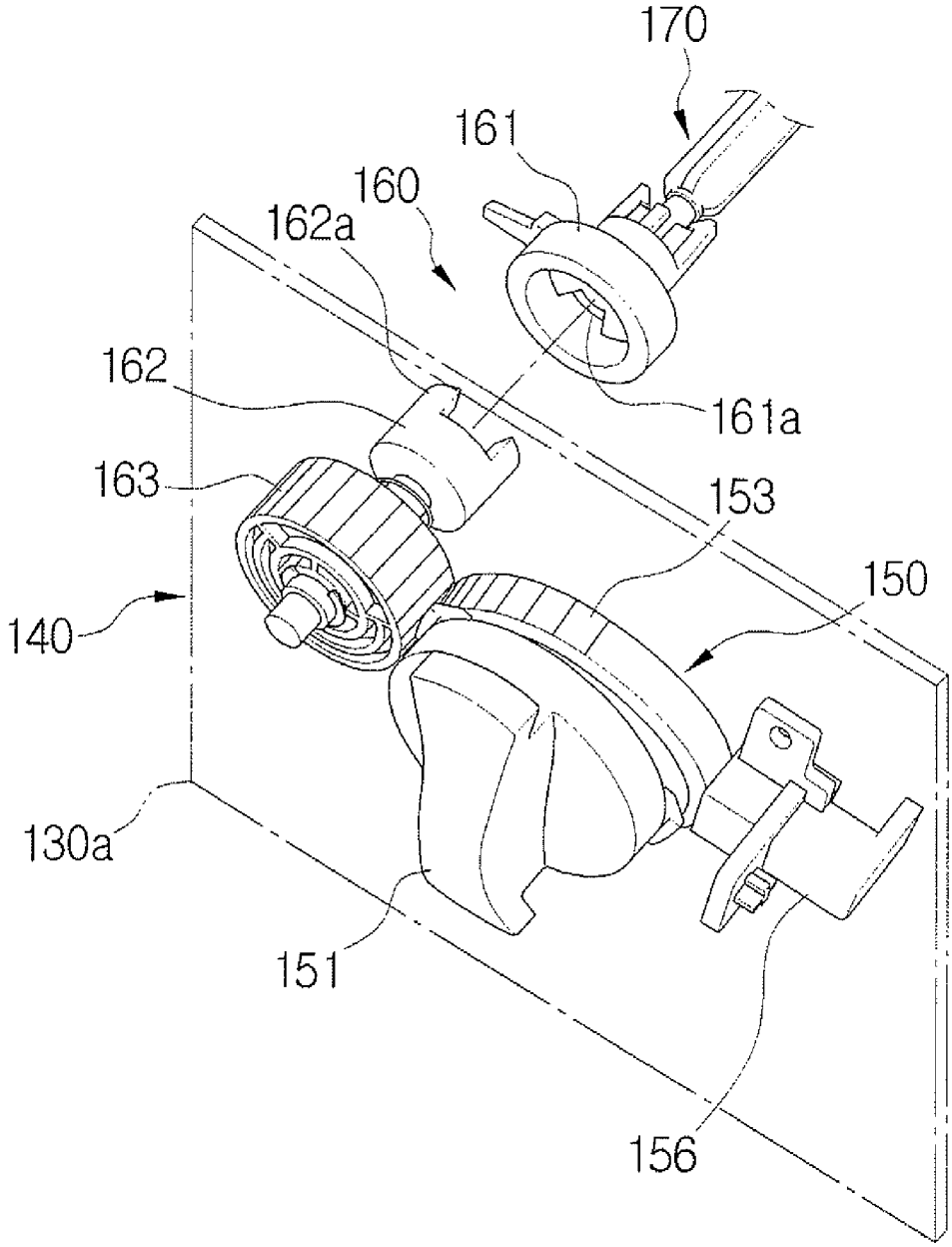
FIG. 7 is a perspective view illustrating a locking apparatus according to an embodiment of the present general inventive concept while separated from a coupling unit.

Referring to FIGS. 6 and 7, the coupling unit 160 includes a first coupling 161 disposed at the lever unit 170, a second coupling 162 detachably connected with the first coupling 161, and the coupling gear 163 that is coaxially connected with the second coupling 162 and rotatably disposed at the supporting cover 130. Therefore, rotation of the coupling gear 163 causes the second coupling 162 to rotate, and rotation of the second coupling 162 causes the first coupling 161 to rotate. The first and second couplings 161 and 162 may comprise various coupling structures as long as the coupling structures are capable of transmitting a rotational force and being separated from each other.

In this embodiment, the second coupling 162 is formed in a cylindrical shape with a plurality of jaws 162*a* at a front end thereof. The first coupling 161 is formed in a hollow cylindrical shape capable of receiving the second coupling 162 and provided with a plurality of holes 161*a* at a bottom surface thereof into which the plurality of jaws 162*a* of the second coupling 162 is inserted. For example, if the second coupling 162 has two jaws 162*a*, the first coupling 161 has two holes 161*a*. Therefore, when the plurality of jaws 162*a* of the second coupling 162 is inserted into the plurality of holes 161*a* of the first coupling 161, a rotational force of the second coupling 162 is transmitted to the first coupling 161.

Furthermore, the second coupling 162 may be formed in a hollow cylindrical shape so that it can move in an axial direction of a shaft 164 of the coupling gear 163 but cannot rotate with respect to the shaft 164 of the coupling gear 163. A pressure member 165, such as a compression spring, may be disposed between the second coupling 162 and the coupling gear 163. Then, when the supporting cover 130 is fixed to the engine frame 110, the jaws 162*a* of the second coupling 162 press the bottom surface of the first coupling 161. As a result, when the supporting cover 130 is fixed to the engine frame 110 and the jaws 162*a* of the second coupling 162 is not inserted into the holes 161*a* of the first coupling 161, a user rotates the locking handle 151 so that the second coupling 162 rotates to cause the jaws 162*a* of the second coupling 162 to insert into the holes 161*a* of the first coupling 161. Therefore, a rotational force of the second coupling 162 is normally transmitted to the first coupling 161.

Referring back to FIG. 3, the image forming apparatus 100 is provided with two locking handles 151 and 151' disposed at the outer surface of the supporting cover 130. A right locking handle 151 operates the locking apparatus 140 according to an embodiment. However, a left locking handle 151' does not connect with the coupling unit 160 of the locking apparatus 140 according to an embodiment. Therefore, a rotation of the left locking handle 151' operates only the cover fixing member 156.

Hereinafter, operation of the locking apparatus 140 of the image forming apparatus according to an embodiment will be explained in details with reference to FIGS. 6 and 7.

First, it will be explained how to separate the supporting cover 130 from the engine frame 110, as illustrated in FIG. 3.

Figure 8B:
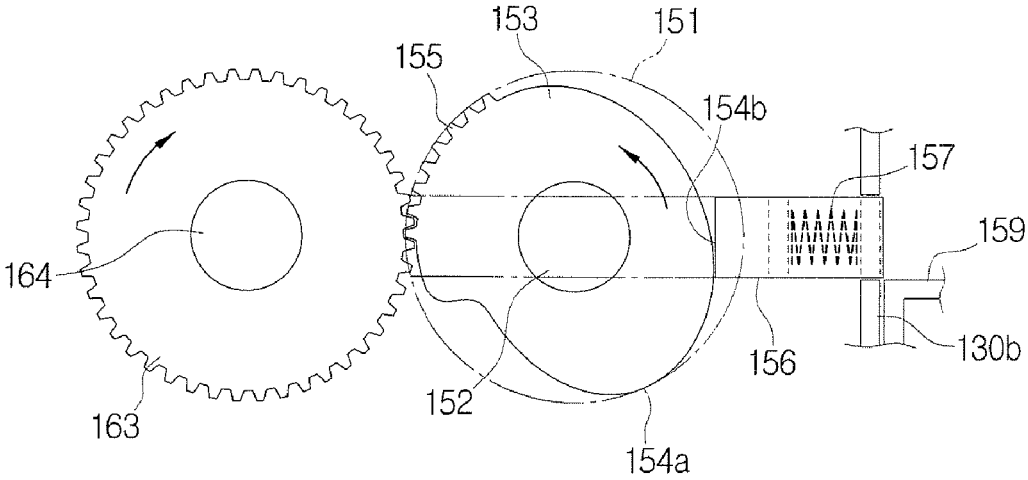

When separating the supporting cover 130 from the engine frame 110, the locking handle 151 is rotated by approximately 90 degrees in a clockwise direction as illustrated in FIG. 8A. When the locking handle 151 rotates by approximately 90 degrees as illustrated in FIG. 8B, the cam gear 153 formed integrally with the locking handle 151 also rotates by approximately 90 degrees. When the cam gear 153 rotates by approximately 90 degrees, the cam part 154 of the cam gear 153, in contact with the back end of the cover fixing member 156, moves from the high point 154*a* to the low point 154*b*. Then, the cover fixing member 156 is moved inside the supporting cover 130 by the elastic member 157, disposed between the cover fixing member 156 and the supporting cover 130, so that the front end of the cover fixing member 156 escapes from a hooking part 159. Therefore, a user can separate the supporting cover 130 from the engine frame 110. FIG. 4 illustrates the image forming apparatus 100 after the supporting cover 130 is separated.

In addition to the above operations, when the cam gear 153 rotates by approximately 90 degrees in the clockwise direction, the coupling gear 163, which is engaged with the gear part 154 of the cam gear 153, rotates in a counterclockwise direction. When the coupling gear 163 rotates in the counterclockwise direction, the second coupling 162 coaxially disposed with the coupling gear 163 rotates in the counterclockwise direction. When the second coupling 162 rotates, the first coupling 161, which is engaged with the second coupling 162, rotates. When the first coupling 161 rotates, the lever shaft 171 formed integrally with the first coupling 161 rotates in the counterclockwise direction.

When the lever shaft 171 rotates in the counterclockwise direction, the press lever 173 and fixing lever 175 also rotate by approximately 90 degrees in the counterclockwise direction. When the press lever 173 rotates by approximately 90 degrees in the counterclockwise direction, the front end of the press lever 173 moves away from the press plate 180, as illustrated in FIG. 9B. As a result, the press plate 180 moves upwardly due to the return member 183 so that the intermediate transfer belt 121 is separated from the photosensitive medium 116 of the image forming unit 114*a*. When the intermediate transfer belt 121 is separated from the photosensitive medium 116, the photosensitive medium 116 does not rub against the intermediate transfer belt 121 during separation of the image forming unit 114*a* from the engine frame 110 so that no scratch and/or damage occurs.

When the fixing lever 175 rotates by approximately 90 degrees in the counterclockwise direction due to movement of the lever shaft 171, the fixing lever 175 escapes from the fixing recess 177 as illustrated in FIG. 9B. Therefore, a user can separate the intermediate transfer belt unit 120 from the engine frame 110.

When mounting the supporting cover 130 to the engine frame 110, the reference bushing 131 formed at the inner surface 130*a* of the supporting cover 130 is brought in line with the reference pin 111 of the engine frame 110. Also, the four shaft holes 135 formed at the inner surface 130*a* of the supporting cover 130 are brought in line with the shafts 115 of the photosensitive media 116 of the four image forming units 114. Then, the supporting cover 130 is pushed to tightly contact the engine frame 110 so that the second coupling 162 of the locking apparatus 140 is coupled with the first coupling 161 thereof. In this state, the locking handle 151 can be rotated by approximately 90 degrees in the counterclockwise direction so that the cover fixing member 156 projects out from the side surface 130*b* of the supporting cover 130, as illustrated in FIG. 8A, thereby causing the supporting cover 130 to be fixed to the engine frame 110. Also, the press lever 173 forces the intermediate transfer belt 121 to contact the photosensitive medium 116, and the fixing lever 175 causes the intermediate transfer belt unit 120 to be fixed to the engine frame 110.

Hereinafter, a process that rotation of the locking handle 151 causes the locking unit 150 and the lever unit 170 to operate will be explained in detail.

When the locking handle 151 rotates by approximately 90 degrees in the counterclockwise direction, the cam gear 153 rotated integrally with the locking handle 151 also rotates by approximately 90 degrees in the counterclockwise direction. When the cam gear 153 rotates by approximately 90 degrees, the cam part 154 of the cam gear 153 to contact the back end of the cover fixing member 156 moves from the low point 154*b* to the high point 154*a* as illustrated in FIGS. 8B and 8A. As a result, the cover fixing member 156 presses the elastic member 157 and moves so that the front end of the cover fixing member 156 projects from the side surface 130*b* of the supporting cover 130 as illustrated in FIG. 8A. When the front end of the cover fixing member 156 projects from the supporting cover 130, it is hooked to the hooking part 159 of the engine frame 110 so that the supporting cover 130 is fixed to the engine frame 110.

When the cam gear 153 rotates by approximately 90 degrees in the counterclockwise direction, the coupling gear 163 engaged with the gear part 155 of the cam gear 153 rotates by approximately 90 degrees in the clockwise direction. When the coupling gear 163 rotates by approximately 90 degrees in the clockwise direction, the first and second couplings 161 and 162 allow the lever shaft 171 to rotate by approximately 90 degrees in the clockwise direction. When the lever shaft 171 rotates by approximately 90 degrees in the clockwise direction, the press lever 173 and the fixing lever 175 also rotate by approximately 90 degrees in the same direction. When the press lever 173 rotates by approximately 90 degrees in the clockwise direction, the front end of the press lever 173 presses the press plate 180 as illustrated in FIG. 9A. When the press plate 180 is pressed, the transfer backup roller 181 moves downwardly so that the intermediate transfer belt 121 comes in contact with the photosensitive medium 116 of the image forming unit 114*a*. Also, the fixing lever 175 rotates by approximately 90 degrees in the clockwise direction to insert into the fixing recess 177 formed at the engine frame 110. As a result, the intermediate transfer belt unit 120 is fixed to the engine frame 110.

As described above, with the locking apparatus 140 of the image forming apparatus 100 according to various embodiments, a plurality of parts, that is, the cover fixing member 156, the press lever 173, and the fixing lever 175 can be operated just by rotating the locking handle 151. In other words, when a user rotates the locking handle 151 in the first direction, the supporting cover 130 is fixed to the engine frame 110, the intermediate transfer belt 121 comes in contact with the photosensitive medium 116, and the intermediate transfer belt unit 120 is fixed to a predetermined position of the engine frame 110 so that the image forming apparatus 100 becomes ready to perform a printing operation.

Furthermore, when the user rotates the locking handle 151 in the second direction, the supporting cover 130 is separated from the engine frame 110, the intermediate transfer belt 121 comes apart from the photosensitive medium 116, and fixing of the intermediate transfer belt unit 120 is released so that the image forming unit 114 can be separated from the engine frame 110 without damage.

As described above, with a locking apparatus of an image forming apparatus according to various embodiments and an image forming apparatus having the same, a plurality of parts can be operated just by rotating a locking handle. In other words, as a user rotates the locking handle, the cover fixing member to fix the supporting cover, the press lever to cause the intermediate transfer belt to contact the photosensitive medium, and the fixing lever to fix the intermediate transfer belt unit to the engine frame can be operated at once.

Therefore, when replacing or just checking out the disposable image forming unit, a user rotates only the locking handle to separate the image forming unit from the engine frame. After replacing the image forming unit, the user closes the supporting cover and rotates only the locking handle so that the image forming apparatus becomes in a state ready to perform a print operation. As a result, according to the various embodiments, it is very convenient for a user to maintenance the image forming apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A locking apparatus of an image forming apparatus comprising:

a lever unit disposed at an intermediate transfer belt frame to cause an intermediate transfer belt to contact a photosensitive medium;

a locking unit disposed at a supporting cover to cause the supporting cover to be fixed to and separated from an engine frame; and a coupling unit to cause the lever unit to operate in association with the locking unit, and to cause the locking unit to be connected to or separated from the lever unit when the supporting cover is fixed to or separated from the engine frame.

2. The locking apparatus of claim 1, wherein the lever unit comprises:

a lever shaft rotatably supported by the intermediate transfer belt frame; and at least one press lever disposed at the lever shaft to be substantially vertical to the lever shaft.

3. The locking apparatus of claim 2, wherein the lever unit further comprises:

a fixing lever disposed at an end of the lever shaft to fix the intermediate transfer belt frame not to be separated from the engine frame in an axial direction of the lever shaft.

4. A locking apparatus of an image forming apparatus comprising:

a lever unit disposed at an intermediate transfer belt frame to cause an intermediate transfer belt to contact a photosensitive medium;

a locking unit disposed at a supporting cover to cause the supporting cover to be fixed to or separated from an engine frame; and a coupling unit to cause the ever unit to operate in association with the locking unit, wherein the locking unit comprises:

a locking handle rotatably disposed at the supporting cover;

a cam gear coaxially disposed with the locking handle to rotate integrally with the locking handle; and a cover fixing member disposed at a side of the cam gear to project from a side surface of the supporting cover or to move inside the supporting cover according to an operation of the locking handle.

5. The locking apparatus of claim 4, wherein the locking unit further comprises:

an elastic member to support the cover fixing member to move inside the supporting cover.

6. The locking apparatus of claim 4, wherein the cam gear comprises:

a gear part to cause the coupling unit to rotate; and a cam part to cause the cover fixing member to move.

7. A locking apparatus of an image forming apparatus comprising:

a lever unit disposed at an intermediate transfer belt frame to cause an intermediate transfer belt to contact a photosensitive medium;

a locking unit disposed at a supporting cover to cause the supporting cover to be fixed to or separated from an engine frame; and a coupling unit to cause the lever unit to operate in association with the locking unit, wherein the coupling unit comprises:

a first coupling disposed at the lever unit;

a second coupling detachably coupled with the first coupling; and a coupling gear coaxially connected with the second coupling and rotatably disposed at the supporting cover.

8. The locking apparatus of claim 7, wherein the second coupling comprises a plurality of jaws, and the first coupling comprises a plurality of holes into which the plurality of jaws is inserted.

9. The locking apparatus of claim 8, wherein the second coupling is disposed at a shaft of the coupling gear to move in an axial direction of the shaft of the coupling gear, and wherein the coupling unit further comprises a press member disposed between the second coupling and the coupling gear.

10. An image forming apparatus comprising:

an engine frame disposed inside the image forming apparatus;

an intermediate transfer belt unit disposed inside the engine frame to support an intermediate transfer belt to move endlessly in a closed loop;

at least one image forming unit disposed below the intermediate transfer belt unit to comprise a photosensitive medium;

a lever unit disposed at an intermediate transfer belt frame of the intermediate transfer belt unit to cause the intermediate transfer belt to contact the photosensitive medium;

a locking unit disposed at a supporting cover to cause the supporting cover to be fixed to and separated from the engine frame; and a coupling unit to cause the lever unit to operate in association with the locking unit, and to cause the locking unit to be connected to or separated from the lever unit when the supporting cover is fixed to or separated from the engine frame.

11. The image forming apparatus of claim 10, wherein the lever unit comprises:

a lever shaft rotatably supported by the intermediate transfer belt frame; and at least one press lever disposed at the lever shaft to be substantially vertical to the lever shaft.

12. The image forming apparatus of claim 11, wherein the lever unit further comprises a fixing lever disposed at an end of the lever shaft to fix the intermediate transfer belt frame not to be separated from the engine frame in an axial direction of the lever shaft.

13. The image forming apparatus of claim 10, wherein the locking unit comprises:

a locking handle rotatably disposed at the supporting cover;

a cam gear coaxially disposed with the locking handle to rotate integrally with the locking handle; and a cover fixing member disposed at a side of the cam gear to project from a side surface of the supporting cover or to move inside the supporting cover according to an operation of the locking handle.

14. The image forming apparatus of claim 10, wherein the coupling unit comprises:

a first coupling disposed at the lever unit;

a second coupling detachably coupled with the first coupling; and a coupling gear coaxially connected with the second coupling and rotatably disposed at the supporting cover.

15. The image forming apparatus of claim 10, wherein the supporting cover comprises at least one shaft hole formed at an inner surface thereof to support a shaft of the photosensitive medium of the at least one image forming unit.

16. The image forming apparatus of claim 10, further comprising:

at least one reference bushing disposed at the supporting cover; and at least one reference pin disposed at the engine frame corresponding to the at least one reference bushing, wherein when the supporting cover is mounted to the engine frame, the reference pin is inserted into the reference bushing.

17. A locking apparatus of an image forming apparatus comprising:

a first member to extend and cause an intermediate transfer belt to contact a photosensitive medium;

a second member to extend to and retract from a supporting cover to cause the supporting cover to be fixed to and separated from an engine frame; and a coupling unit to cause the first member to operate in association with the second member, wherein the coupling unit comprises:

a first coupling disposed at the first member;

a second coupling detachably coupled with the first coupling; and a coupling gear coaxially connected with the second coupling and rotatably disposed at the supporting cover.

18. The locking apparatus of claim 17, wherein the coupling unit further comprising:

a cam gear to simultaneously rotate the coupling gear and to extend and retract the second member.

19. The locking apparatus of claim 18, further comprising:

a locking handle rotatably disposed on the supporting cover to operate the cam gear.

* * * * *